US006703987B2

(12) United States Patent
Yabuki

(10) Patent No.: US 6,703,987 B2
(45) Date of Patent: Mar. 9, 2004

(54) HELICAL ANTENNA

(75) Inventor: Keiichi Yabuki, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 30 days.

(21) Appl. No.: 10/169,573

(22) PCT Filed: Oct. 18, 2001

(86) PCT No.: PCT/JP01/09154

§ 371 (c)(1),
(2), (4) Date: Jul. 5, 2002

(87) PCT Pub. No.: WO02/45208

PCT Pub. Date: Jun. 6, 2002

(65) Prior Publication Data

US 2002/0190917 A1 Dec. 19, 2002

(30) Foreign Application Priority Data

Nov. 28, 2000 (JP) ..... 2000-360671

(51) Int. Cl.[7] ..... H01Q 1/36
(52) U.S. Cl. ..... 343/895; 343/870; 343/873
(58) Field of Search ..... 343/866, 870, 343/873, 872, 900, 906, 715, 895, 896

(56) References Cited

U.S. PATENT DOCUMENTS 5,859,617 A * 1/1999 Fujikawa ..... 343/702
6,262,693 B1 * 7/2001 Sutter et al. ..... 343/895
6,369,775 B1 * 4/2002 Moore et al. ..... 343/893

FOREIGN PATENT DOCUMENTS

| | | |
|---|---|---|
| JP | 76675/1988 | 12/1989 |
| JP | 116009/1990 | 6/1992 |
| JP | 08-222927 | 8/1996 |
| JP | 10-079614 | 3/1998 |
| JP | 10-270921 | 10/1998 |
| JP | 11-088024 | 3/1999 |
| JP | 11-355029 | 12/1999 |

* cited by examiner

*Primary Examiner*—Tuyet T. Vo
(74) *Attorney, Agent, or Firm*—Connolly Bove Lodge & Hutz LLP

(57) ABSTRACT

When a contact terminal 11 is mounted by being inserted into a bobbin 12 from the bottom end thereof, the contact terminal 11 is fixed to the bottom part of the bobbin 12 by the action of raised tabs 11*c* which prevents the contact terminal 11 from coming off. Next, a folded portion 13*c* formed on the bottom end of a coil element 13 is inserted into the bobbin 12 from the top thereof, and the folded portion 13*c* is fixed there by being press-fitted between press-fitting members 11*b*. Next, a top cover portion 10 is fitted by insertion to the bobbin 12 from the top of the coil element-supporting bobbin 12. As a result, four coupling members 10*a* are fixed by being inserted between first ribs 12*c* and second ribs 12*d* formed in the bottom part of bobbin 12. Since this helical antenna is assembled without the need of using assembly jigs or tools and without using adhesives, assembly can be done easily, and costs can be reduced.

6 Claims, 11 Drawing Sheets

HELICAL ANTENNA

TECHNICAL FIELD

The present invention is related to a helical antenna, which is provided on a portable radiotelephone, such as a cellular telephone.

BACKGROUND ART

Cellular telephones have come into widespread use recently, and antennas are provided on these cellular telephones for the transmitting and receiving of telephone calls and data. As this antenna, a helical antenna, which is mounted in a fixed condition to and protrudes only slightly from the casing of the cellular telephone for convenience of carrying, is well known.

An example of the constitution of a prior helical antenna such as this is shown in FIG. 12.

The helical antenna 100 shown in this figure is constituted from a coil element 113, in which a coil portion 113*a* is formed; a top cover portion 110, which is integrally molded so as to cover this coil element 113; and a metal base fixture 112, to which the bottom end of coil portion 113*a* is connected electrically, and, in addition, to which the bottom end of top cover portion 110 is molded.

In the prior helical antenna 100 shown in FIG. 12, coil element 113 comprises an insulative main casing formed in an approximately cylindrical shape, and a helical groove formed in the peripheral surface of the main body. Coil portion 113*a* is formed inside this groove by either depositing or attaching a metallic thin film thereinto. Helical antenna 100 is made by screwing the bottom end of the coil element 113 formed in this manner onto the top part of metal base fixture 112, and integrally molding top cover portion 110 so as to cover the entire coil element 113 and the top part of metal base fixture 112. Then, helical antenna 100 is mounted in a fixed condition to the casing of a portable radiotelephone by screwing a screw portion 112*a* formed in the bottom part of metal base fixture 112 into a mounting fixture provided in the casing of the portable radiotelephone.

However, the problem with a prior helical antenna 100 was that the number of processes for making coil element 113 were numerous, and it took time to assemble the helical antenna 100, thus causing costs to rise. Another problem was that because the helical antenna 100 was mounted in a fixed condition to the casing of a portable radio by screwing the helical antenna 100 thereto, special tools were required for mounting, and, in addition, it took time.

Accordingly, an object of the present invention is to provide a helical antenna, which can be assembled easily and can reduce costs, and, in addition, can be readily mounted in a fixed condition.

DISCLOSURE OF THE INVENTION

To solve for the above-mentioned problems, a helical antenna of the present invention comprises a top cover portion, which comprises an approximately cylindrical storing portion, the one end of which is closed, and on which is formed a plurality of coupling members, which extend from the bottom part; a coil portion wound in a coil shape; a coil element comprising a leading portion, which extends from one end of this coil portion; a bobbin, which supports the above-mentioned coil portion of this coil element, and in which a through-hole, through which the above-mentioned leading portion is passed, is formed approximately parallel to the central axis; a holding member, which is mounted to the bottom part of this bobbin, and is positioned on the peripheral surface thereof; and a conductive contact terminal, in which is formed press-fitting members, which are positioned on the inside of the above-mentioned through-hole. The tip of the above-mentioned leading portion, which passes through the inside of the above-mentioned through-hole, is press-fitted inside the above-mentioned press-fitting members of the above-mentioned contact terminal, the above-mentioned top cover portion is fitted by insertion to the above-mentioned bobbin, and the top part of the above-mentioned bobbin, which supports the above-mentioned coil portion, is stored inside the above-mentioned storing portion.

Further, in the above-mentioned helical antenna of the present invention, when the above-mentioned coupling members pass through and mate with the power supply fixture disposed in the casing, the holding member of the above-mentioned contact terminal can be electrically connected to the above-mentioned power supply fixture.

Furthermore, in the above-mentioned helical antenna of the present invention, the above-mentioned contact terminal comprises the above-mentioned holding member, which is formed by being bent into a U-shape, and press-fitting members comprising approximately parallelly positioned elongated plates formed by rising up from approximately the center portion of this holding member, and raised tabs can be formed on these press-fitting members so that [the contact terminal] does not slip out when inserted into the above-mentioned through-hole.

Furthermore, a plurality of ribs is formed on the bottom part of the above-mentioned bobbin, and the above-mentioned coupling members can be arranged between the above-mentioned ribs when the above-mentioned top cover portion is inserted into the above-mentioned bobbin.

Furthermore, in the above-mentioned helical antenna of the present invention, when the above-mentioned contact terminal is mounted to the bottom part of the above-mentioned bobbin, the above-mentioned holding member can be positioned inside the grooved portions formed on the surface of the above-mentioned ribs.

Furthermore, in the above-mentioned helical antenna of the present invention, the cross-sectional shape of the through-hole formed in the bottom part of the above-mentioned bobbin, into which the above-mentioned press-fitting members are inserted, represents an H shape, and the cross-sectional shape of the through-hole, through which the above-mentioned leading portion is passed in the above-mentioned coil element, represents an I shape, and the bottom end of the above-mentioned leading portion can be folded.

According to this present invention, the tip of the leading portion of the coil element, which passes through the inside of the bobbin through-hole, is press-fitted inside the press-fitting members of the contact terminal arranged inside the through-hole, and the top part of the bobbin, which supports the coil portion, is stored inside the storing portion by the top cover portion being fitted in the bobbin by being inserted therein. Thus, assembly of a helical antenna can be performed easily without using special tools, making it possible to reduce costs.

Further, by inserting the helical antenna into a power supply fixture disposed in the casing of a portable radiotelephone, coupling members disposed on the top cover portion mate with the power supply fixture, making it possible for the helical antenna to be mounted to the casing

[of a portable radiotelephone] in a fixed condition. This enables the helical antenna to be mounted in a fixed condition to the casing [of a portable radiotelephone] easily and in a short period of time.

Furthermore, since the contact terminal can be formed by processing sheet metal, the coil element can be formed by processing a wire into a coil shape, and the bobbin and top cover portion can be readily formed by plastic molding, each part can be made easily, enabling the cost of the helical antenna to be reduced.

BRIEF DESCRIPTION OF THE DRAWINGS

FIG. 5(*b*) is a bottom view showing the constitution of a helical antenna of an aspect of the embodiment of the present invention;

FIG. 7(*b*) is a front view showing the detailed constitution of the bobbin in a helical antenna of an aspect of the embodiment of the present invention;

FIG. 7(*c*) is a bottom view showing the detailed constitution of the bobbin in a helical antenna of an aspect of the embodiment of the present invention;

FIG. 8(*b*) is a line C—C cross-sectional view showing the detailed constitution of the bobbin in a helical antenna of an aspect of the embodiment of the present invention;

FIG. 8(*c*) is a line D—D cross-sectional view showing the detailed constitution of the bobbin in a helical antenna of an aspect of the embodiment of the present invention;

FIG. 9(*b*) is a bottom view showing the detailed constitution of the contact terminal in a helical antenna of an aspect of the embodiment of the present invention;

FIG. 9(*c*) is a side view showing the detailed constitution of the contact terminal in a helical antenna of an aspect of the embodiment of the present invention;

FIG. 9(*d*) is a line E—E cross-sectional view showing the detailed constitution of the contact terminal in a helical antenna of an aspect of the embodiment of the present invention;

FIG. 9(*e*) is a partially enlarged view showing the detailed constitution of the contact terminal in a helical antenna of an aspect of the embodiment of the present invention;

FIG. 11(*b*) is a bottom view showing the detailed constitution of the top cover portion in a helical antenna of an aspect of the embodiment of the present invention;

FIG. 11(*c*) is a line F—F cross-sectional view showing the detailed constitution of the top cover portion in a helical antenna of an aspect of the embodiment of the present invention;

FIG. 11(*d*) is a partially enlarged view showing the detailed constitution of the top cover portion in a helical antenna of an aspect of the embodiment of the present invention;

FIG. 12(*b*) is a bottom view showing the detailed an example of a constitution of a prior helical antenna.

BEST MODE FOR CARRYING OUT THE INVENTION

Figure 1:
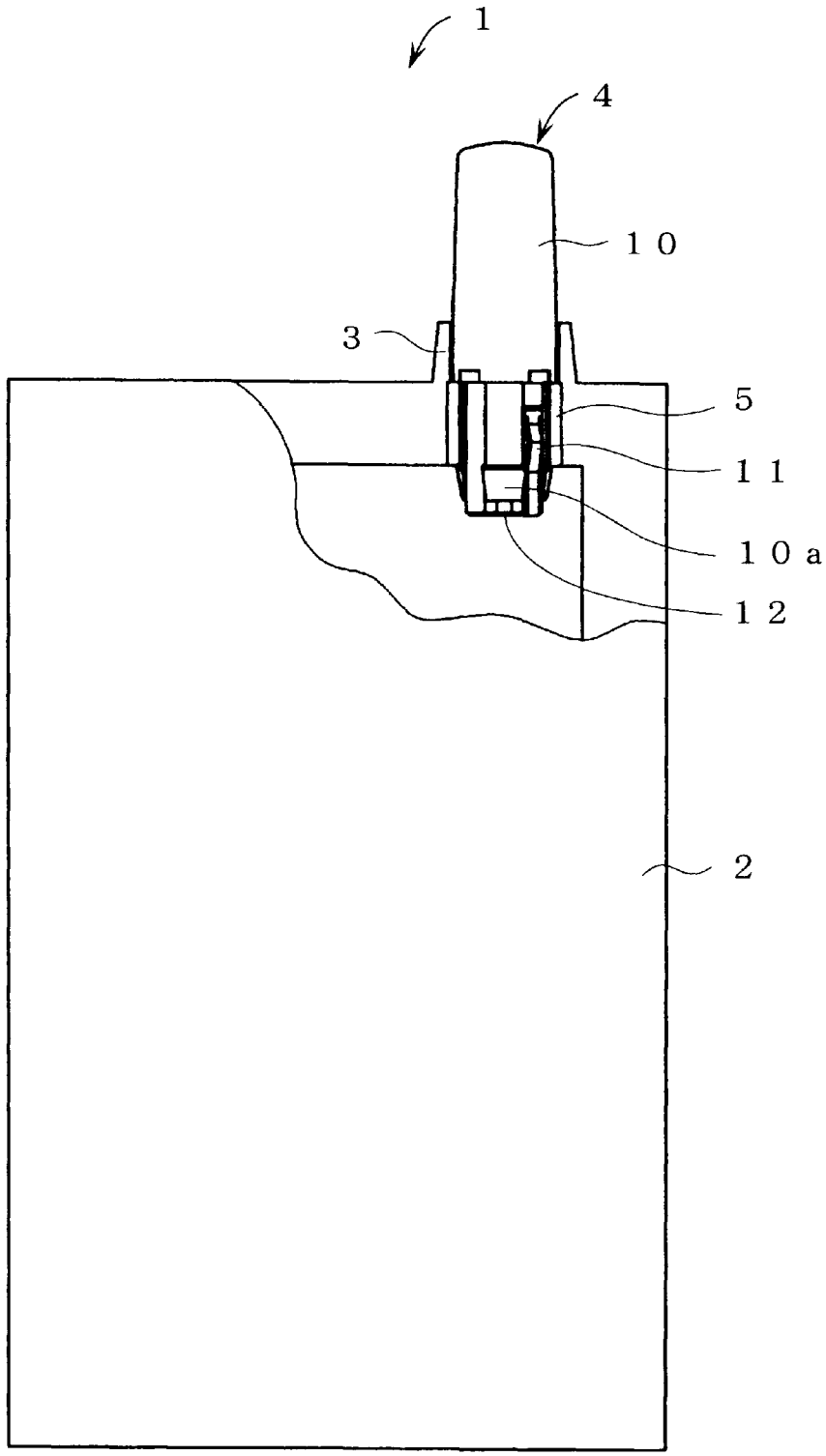
FIG. 1 is a diagram showing a constitution, wherein a helical antenna of an aspect of the embodiment of the present invention is applied to a portable radiotelephone.
Figure 2:
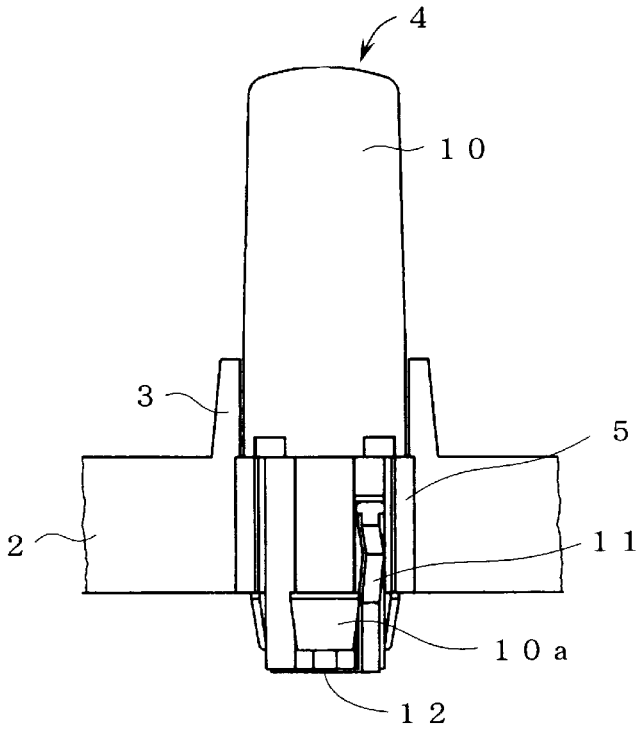
FIG. 2 is a diagram showing an enlarged view of one portion of the constitution, wherein a helical antenna of an aspect of the embodiment of the present invention is applied to a portable radiotelephone.
Figure 3:
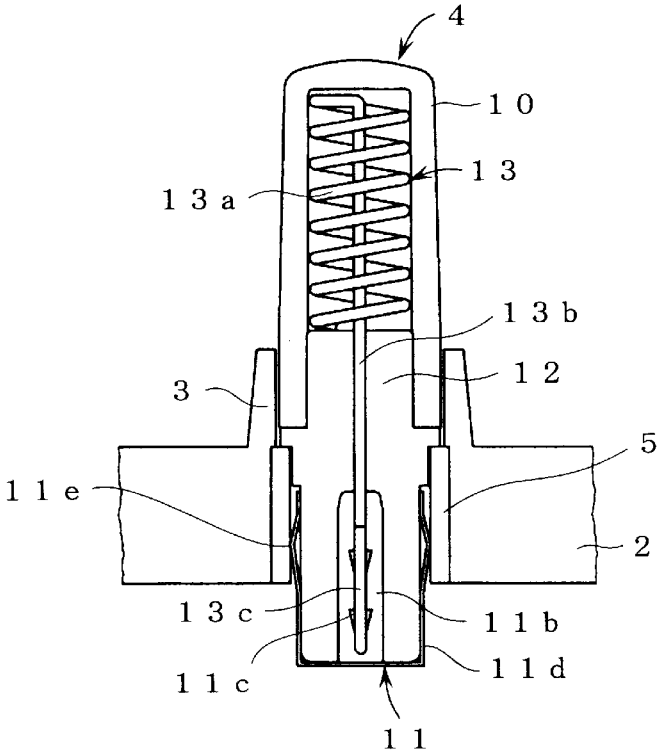
FIG. 3 is a cross-sectional view showing an enlarged view of one portion of the constitution, wherein a helical antenna of an aspect of the embodiment of the present invention is applied to a portable radiotelephone.

A partial cutaway view of a constitution, wherein a helical antenna of an aspect of the embodiment of the present invention is applied to a portable radiotelephone, is shown in FIG. 1, an enlarged view of the cutaway portion is shown in FIG. 2, and a cross-sectional view of the enlarged cutaway portion is shown in FIG. 3.

As shown in these drawings, a ring-shaped portion 3, which protrudes in a ring shape around a through-hole formed in a radio casing 2, is formed in the radio casing 2 of a portable radiotelephone 1, such as a cellular telephone. Then, a power supply fixture 5 of a cylindrical shape is disposed inside the through-hole. A helical antenna 4 related to an aspect of the embodiment of the present invention is mounted by inserting the bottom part [of the helical antenna 4] inside this power supply fixture 5. In other words, when the bottom part of helical antenna 4 is inserted inside power supply fixture 5, the constitution is such that coupling members 10*a*, which are formed so as to extend from the bottom part of helical antenna 4, mate with the bottom surface of power supply fixture 5. By forming wedge-shaped portions with sharply tapered tips at the end portions of these coupling members 10*a*, step portions, which mate with the top of the wedge-shaped portions, are formed.

Furthermore, a contact terminal 11 is arranged around the peripheral surface of the bottom part of helical antenna 4, and when the bottom part of helical antenna 4 is inserted inside power supply fixture 5, contact terminal 11 comes in contact electrically with the inner surface of power supply fixture 5. This enables helical antenna 4 to connect with a transceiving circuit embedded in the radio casing 2.

Further, coupling members 10*a* are integrally formed to the top cover portion 10, and the top cover portion 10 is fitted to the bobbin 12 by being inserted therein. Coil element 13 is supported inside bobbin 12 as shown in FIG. 3. Coil element 13 is constituted from a coil portion 13*a* formed by being wound into a coil shape, and a leading portion 13*b* formed by bending and extending the top end of the coil portion 13*a* downward. A folded portion 13*c*, which is folded upward, is formed at the tip of this leading portion 13*b*, and this folded portion 13*c* is connected electrically by being press-fitted into press-fitting members 11*b* formed in contact terminal 11.

Furthermore, contact terminal 11 comprises a holding member 11*d* formed by being bent into the shape of the letter 4, and press-fitting members 11*b*, which are bent so as to rise up on two sides from approximately the center portion of holding member 11*d*. A plurality of raised tabs 11*c*, which are raised toward the outside, are formed on press-fitting members 11*b*, and when [contact terminal 11] is inserted into the below-described cross-sectional H-shaped insertion hole formed in bobbin 12, the raised tabs 11*c* mate to the inner wall of the insertion hole, preventing the contact terminal 11 from uncoupling from bobbin 12. Spring portions lie are formed in holding member 11*d* by bending the bent end portions into dogleg shapes. These spring portions 11*e* are constituted so as to form a connection by making contact with the inner surface of power supply fixture 5.

Figure 4:
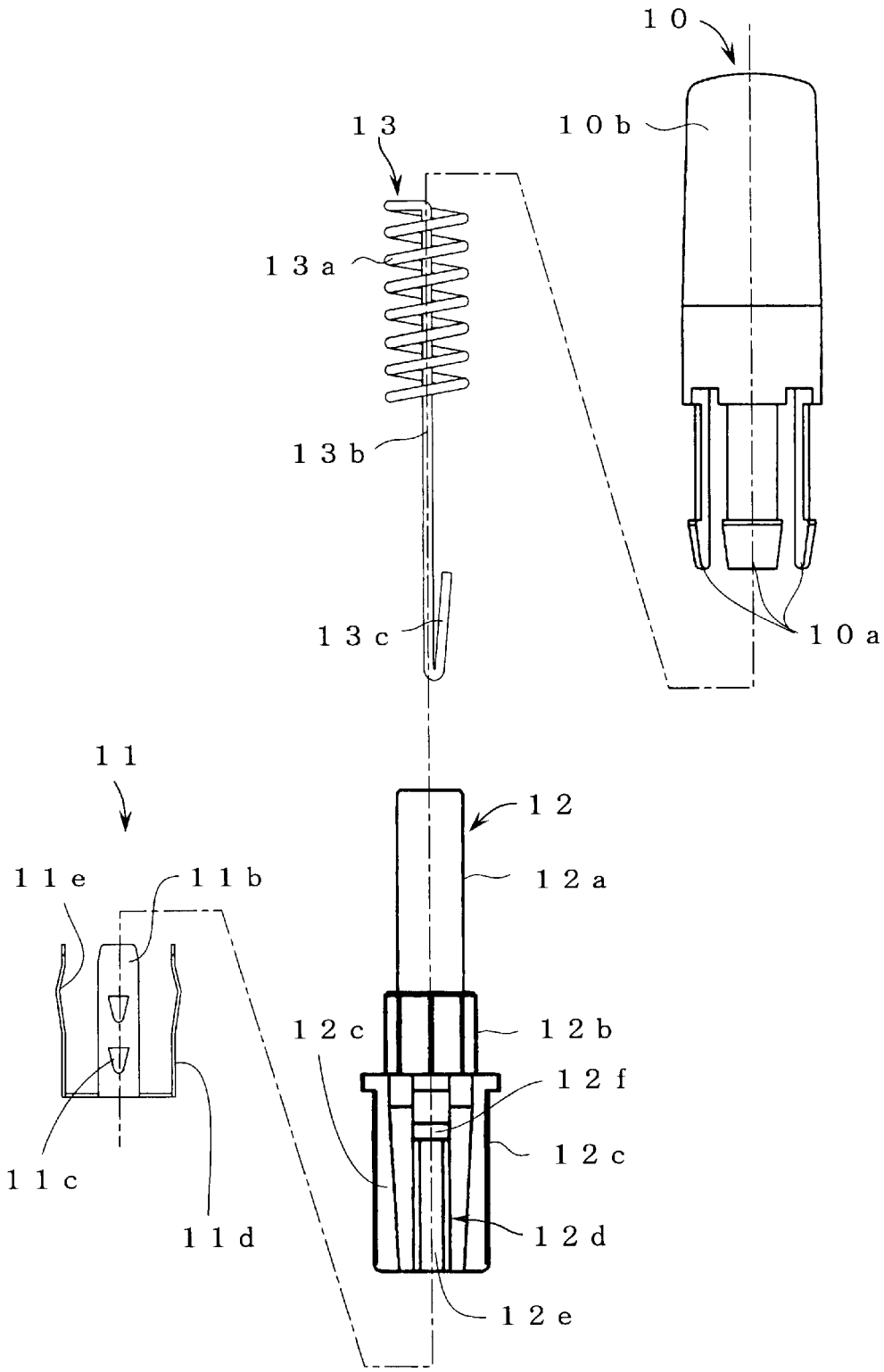
FIG. 4 is an exploded assembly diagram of a helical antenna of an aspect of the embodiment of the present invention.

Next, an exploded assembly diagram of a helical antenna 4 related to an aspect of the embodiment of the present invention is shown in FIG. 4.

To assemble helical antenna 4, first, contact terminal 11 is mounted by inserting it from the bottom end of bobbin 12. At this time, contact terminal 11 is mounted by being rotated approximately 90° within a horizontal plane from the position shown in FIG. 4. By so doing, press-fitting members 11*b* are inserted inside a cross-sectional H-shaped insertion hole formed approximately parallel to the central axis of bobbin 12, and, in addition, holding member 11*d* slides into contact with the inside of rib portions 12*e* formed on the surfaces of second ribs 12*d*. Then, coupling members formed on the end of holding member 11*d* mate with notched portions 12*f* formed in the top parts of second ribs 12*d*. Also, the raised tabs 11*c* formed on press-fitting members 11*b* mate with the inside wall of the insertion hole. In accordance therewith, contact terminal 11 is mounted in a fixed condition in the bottom part of bobbin 12 such that it cannot come uncoupled.

Next, the coil element 13 is readied, and is passed through a through-hole formed approximately in the center of bobbin 12 beginning with the folded portion 13*c* formed at the bottom end of coil element 13. In this case, because the cross-sectional shape of the through-hole is an I shape, coil element 13 is positioned relative to bobbin 12 as it passes through. Since the through-hole connects to the insertion hole, once folded portion 13*c* passes through to the bottom part of bobbin 12, folded portion 13*c* is press-fitted between press-fitting members 11*b* of contact terminal 11, which is mounted to the bottom part [of bobbin 12], and sandwiched therebetween so as not to slip out. Coil element 13 is thereby electrically connected to contact terminal 11. At the same time, coil portion 13*a* is supported by the periphery of a round bar-shaped support portion 12*a*. At this time, the bottom end of coil portion 13*a* comes in contact with the top surface of the bobbin base portion 12*b*, which has a slightly larger diameter than coil support portion 12*a*, and this determines the length of the coil portion 13*a*.

Next, top cover portion 10 is fitted over bobbin 12 so as to cover bobbin 12 holding coil element 13 thereon. By so doing, the four coupling members 10*a* formed so as to extend from the bottom part of top cover portion 10 pass between first ribs 12*c* and second ribs 12*d* formed on the bottom part of bobbin 12. Then, the top parts of first ribs 12*c* and second ribs 12*d* are press-fitted to concave portions formed in top cover portion 10, thereby integrally mounting top cover portion 10 to bobbin 12. Accordingly, it is possible to assemble helical antenna 4 related to an aspect of the embodiment of the present invention. At the time of this assembly, since assembly jigs and tools are not required, and, in addition, assembly is performed without using adhesives, assembly can be carried out using simple equipment.

Figure 5A:
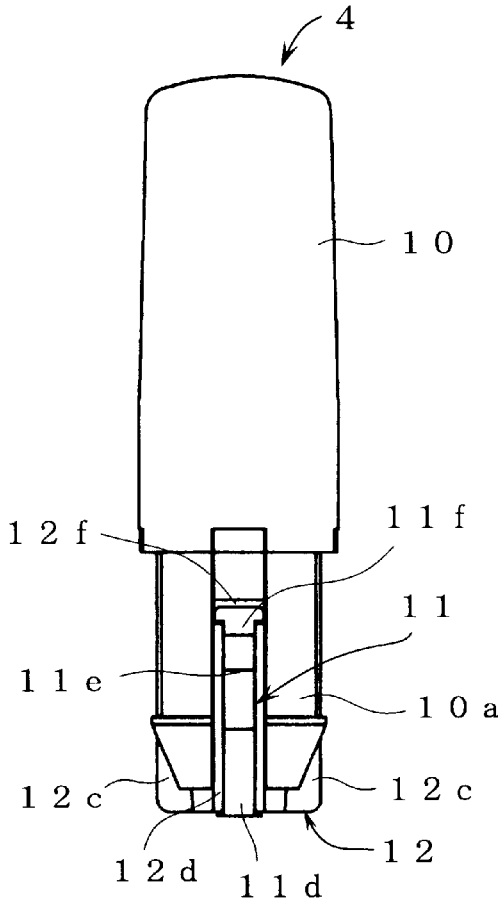
FIG. 5(*a*) is a front view showing the constitution of a helical antenna of an aspect of the embodiment of the present invention.
Figure 5B:
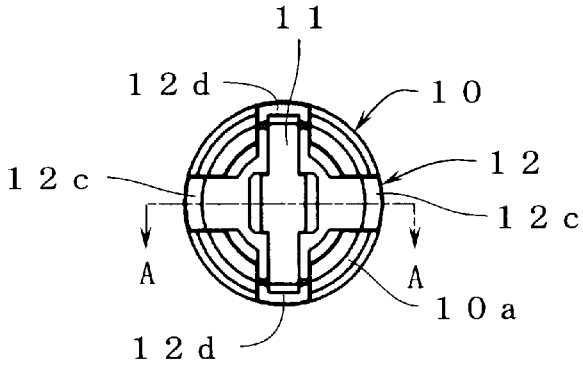
Figure 6:
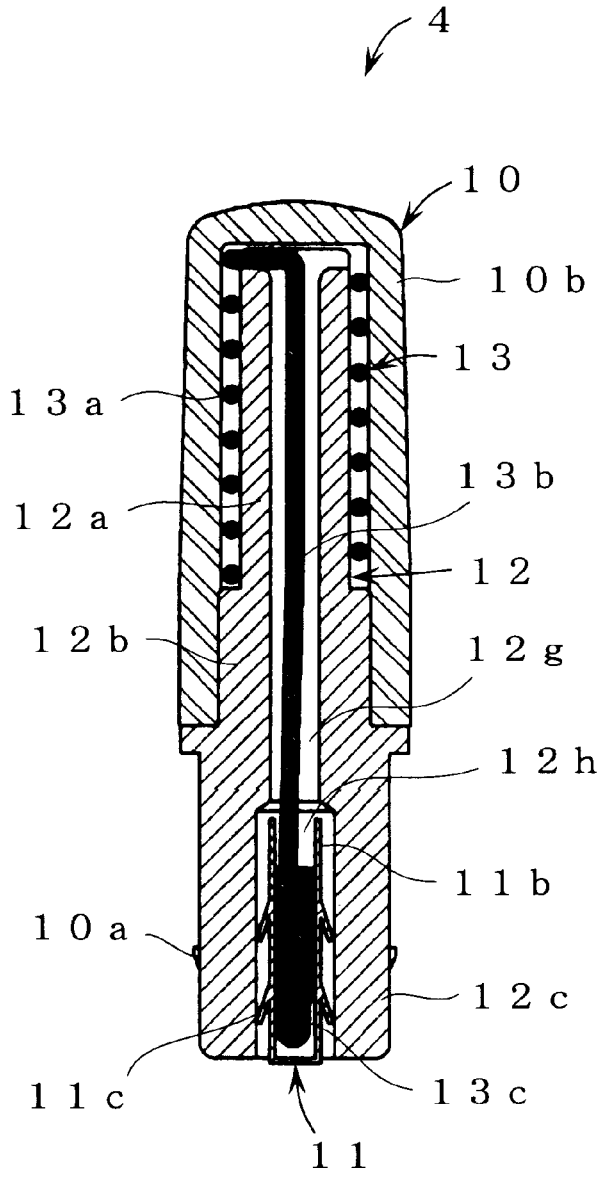
FIG. 6 is a line A—A cross-sectional view showing the constitution of a helical antenna of an aspect of the embodiment of the present invention.

A helical antenna 4 related to the present invention assembled in this manner is shown in FIGS. 5(*a*), (*b*) and FIG. 6. However, FIG. 5(*a*) is a front view of helical antenna 4 related to the present invention, FIG. 5(*b*) is a bottom view thereof, and FIG. 6 is a cross-sectional view of helical antenna 4 cut along line A—A in FIG. 5(*b*).

As shown in these drawings, four coupling members 10*a* formed so as to extend from the bottom part of top cover portion 10 are respectively positioned between first ribs 12*c* and second ribs 12*d* formed on the bottom part of bobbin 12, and holding member 11*d* of contact terminal 11 is positioned inside the grooved portions 12*e* of second ribs 12*d*. Then, coupling members 11*f* broadly formed at the tips of holding member 11*d* mate with notched portions 12*f* formed in the top parts of second ribs 12*d*.

Further, as shown in FIG. 6, leading portion 13*b* of coil element 13, which passes through the inside of through-hole 12*g* formed approximately parallel to the central axis of bobbin 12, passes through insertion hole 12*h*, which connects to through-hole 12*g*. According to this [constitution], folded portion 13*c* formed at the end of leading portion 13*b* is press-fitted between press-fitting members 11*b* formed in contact terminal 11, which is mounted inside insertion hole 12*h*. Furthermore, raised tabs 11*c*, which are cut so as to raise up toward the outside from press-fitting members 11*b*, are constituted so as to pierce the inner wall of insertion hole 12*h*, and this affixes contact terminal 11, which is mounted from the bottom to the bottom part of bobbin 12, so that it cannot slip out of bobbin 12.

Next, details of each of the parts, which constitute helical antenna 4 related to the present invention, will be explained.

Figure 7A:
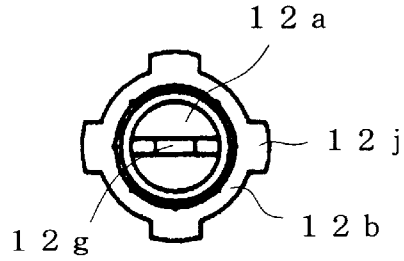
FIG. 7(*a*) is a top view showing the detailed constitution of the bobbin in a helical antenna of an aspect of the embodiment of the present invention.
Figure 7B:
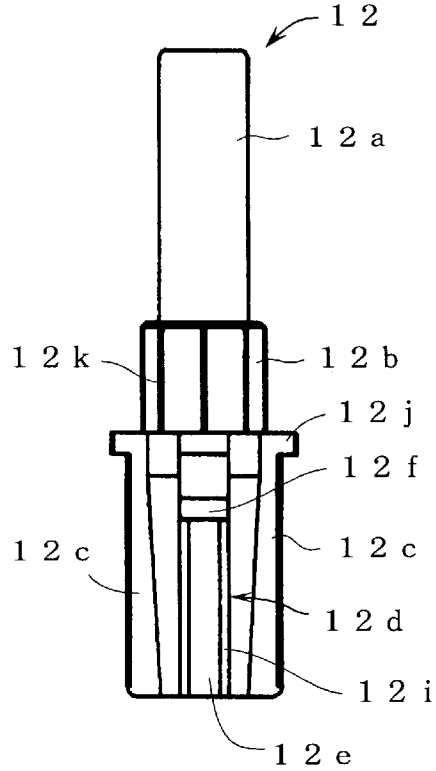
Figure 7C:
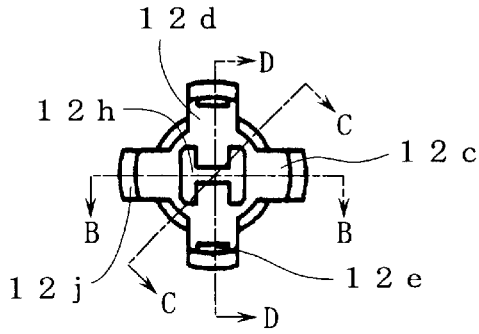
Figure 8A:
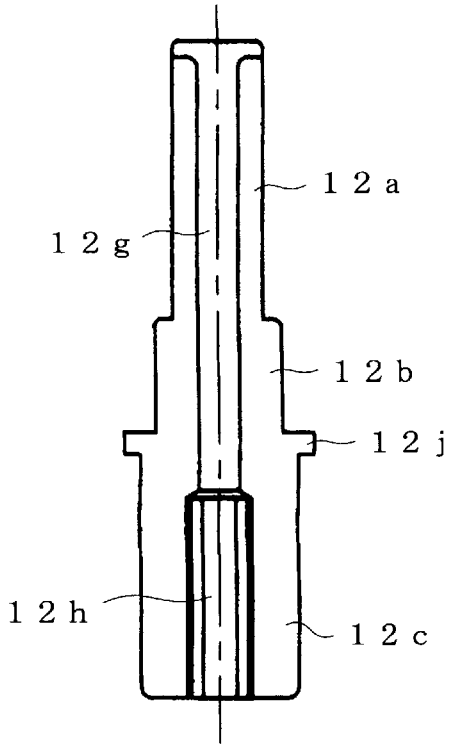
FIG. 8(*a*) is a line B—B cross-sectional view, showing the detailed constitution of the bobbin in a helical antenna of an aspect of the embodiment of the present invention.
Figure 8B:
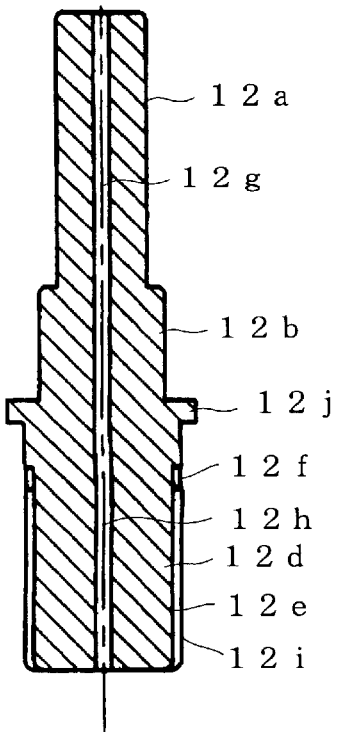
Figure 8C:
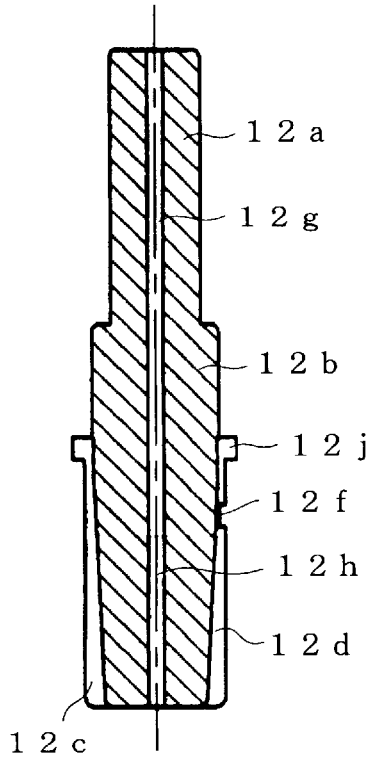
Figure 9A:
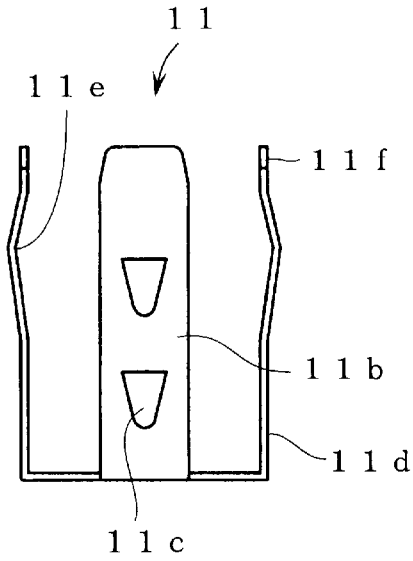
FIG. 9(*a*) is a front view showing the detailed constitution of the contact terminal in a helical antenna of an aspect of the embodiment of the present invention.
Figure 9C:
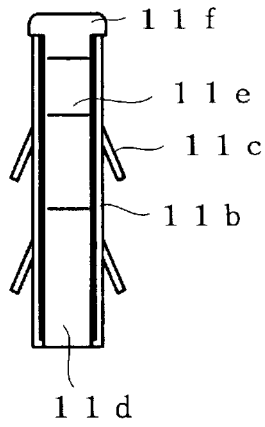
Figure 9B:
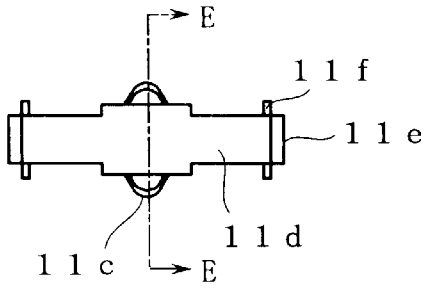
Figure 9D:
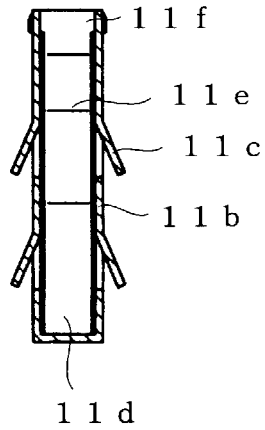
Figure 9E:
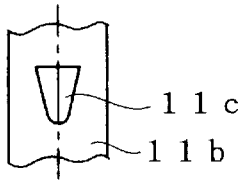

FIG. 7 and FIG. 8 are diagrams showing the detailed constitution of bobbin 12. FIG. 7(*a*) is a top view of bobbin 12, FIG. 7(*b*) is a front view thereof, and FIG. 7(*c*) is a bottom view thereof. Furthermore, FIG. 8(*a*) is a cross-sectional view cut along line B—B of FIG. 7(*c*), FIG. 8(*b*) is a cross-sectional view cut along line D—D of FIG. 7(*c*), FIG. 8(*c*) is a cross-sectional view cut along line C—C of FIG. 7(*c*).

As shown in these drawings, bobbin 12, which is made of a synthetic resin, comprises a narrow-diameter, round bar-shaped coil supporting portion 12*a*, and a slightly larger diameter cross-sectionally circular bobbin base portion 12*b*, which connects to coil supporting portion 12*a*. A plurality of ridges 12*k* is formed on the peripheral surface of the top part of this bobbin base portion 12*b*. When the top cover portion 10 is attached, these ridges 12*k* make contact [with the top cover portion 10] by pressing against the inner surface of the storing portion of the top cover portion 10. Four ribs arranged in the shape of a cross are formed on the outside surface of bobbin base portion 12*b* except for the top part. These four ribs comprise two first ribs 12*c* and two second ribs 12*d*, and first ribs 12*c* and second ribs 12*d*, which are formed opposite one another, are arranged approximately orthogonally. And grooved portions 12*e*, on which holding member 11*d* of contact terminal 11 is positioned, are formed on the surfaces of second ribs 12*d*, and wall portions 12*i* are formed on both sides of these grooved portions 12*e*. Further, notched portions 12*f* are formed in the top parts of second ribs 12*d*, and protruding portions 12*j* are formed at the top ends of first ribs 12*c* and second ribs 12*d*, respectively. These protruding portions 12*j* attach [to the top cover portion 10] by fitting into concave portions formed in the top cover portion 10 when the top cover portion 10 is attached.

Furthermore, as shown in FIG. 8, a through-hole 12*g* and an insertion hole 12*h* are formed approximately along the central axis of bobbin 12. As shown in FIG. 7(*a*), the cross-section of through-hole 12*g* is an elongated rectangle in the shape of the letter I, and [through-hole 12*g*] is formed approximately in the center of coil supporting portion 12*a* and bobbin base portion 12*b*. Further, insertion hole 12*h* connects to through-hole 12*g*, and, as shown in FIG. 7(*c*), its cross-section is in the shape of the letter H, and it is formed from approximately the center to the bottom of bobbin base portion 12*b*. Press-fitting members 11*b* of contact terminal 11 pass through hole portions corresponding to the two vertical bars, respectively, of the letter H of insertion hole 12*h*. Also, a hole portion corresponding to the horizontal bar connecting the two vertical bars of the letter H of insertion hole 12*h* is the hole portion, which extends through-hole 12*g*, and leading portion 13*b* of coil element 13, in which folded portion 13*c* is formed, passes through [this hole portion]. Furthermore, as shown in FIG. 8(*c*), the bobbin base portion 12*b* is formed by tapering the bottom end so that it becomes narrower, and the constitution is such that penetration space is ensured when coupling member 10*a* is fitted into power supply fixture 5.

Next, FIG. 9 is a diagram showing the detailed constitution of contact terminal 11. FIG. 9(*a*) is a front view of contact terminal 11, FIG. 9(*b*) is a bottom view thereof, FIG. 9(*c*) is a side view thereof, FIG. 9(*d*) is a cross-sectional view cut along line E—E of FIG. 9(*c*), and FIG. 9(*e*) is a partially enlarged view of the front view thereof.

As shown in these drawings, press-fitting members 11*b*, which are formed in an elongated condition, are formed so as to stand facing one another from both sides of approximately the center of holding member 11*d*, which is processed metal sheet formed in the shape of the letter U. Two triangular raised tabs 11*c* are formed in these press-fitting members 11*b*, respectively, as shown in the figure. The tips of these raised tabs 11*c* are constituted so as to pierce the inner wall of insertion hole 12*h* of bobbin 12. Further, spring portions 11*e*, which have been bent into dogleg shapes, and wide coupling members 11*f* at the ends thereof, are formed in both side members of the U-shaped holding member 11*d*. These spring portions 11*e* are the parts, which make electrical contact with the inner surface of power supply fixture 5 when helical antenna 4 is mounted to the radio casing 2, and coupling members 11*f* are the parts, which mate to the notched portions 12*f* formed in the top parts of second ribs 12*d* of bobbin 12 when contact terminal 11 is attached to the bottom part of bobbin 12.

Figure 10:
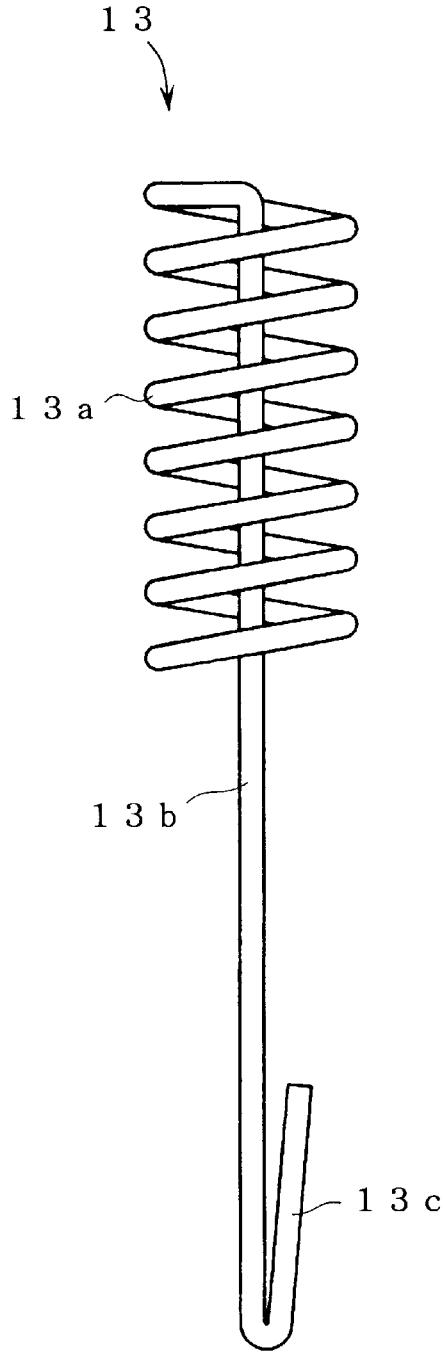
FIG. 10 is a diagram showing the detailed constitution of the coil element in a helical antenna of an aspect of the embodiment of the present invention.
Figure 11A:
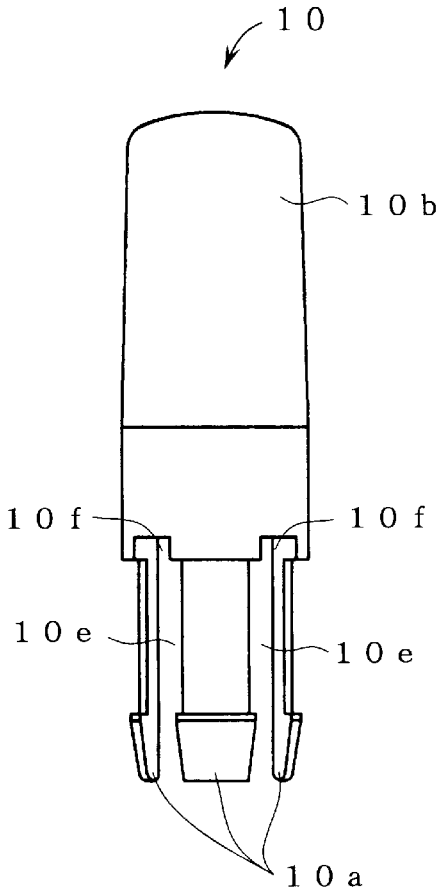
FIG. 11(*a*) is a front view showing the detailed constitution of the top cover portion in a helical antenna of an aspect of the embodiment of the present invention.
Figure 11C:
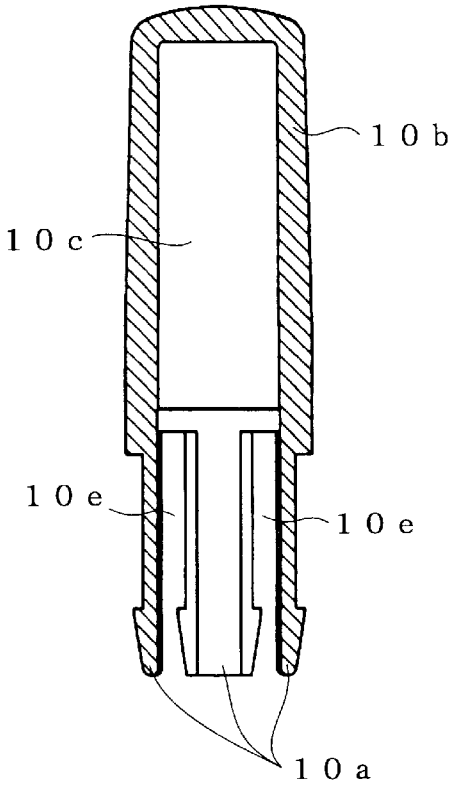
Figure 11B:
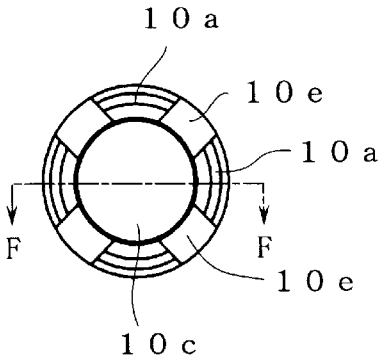
Figure 11D:
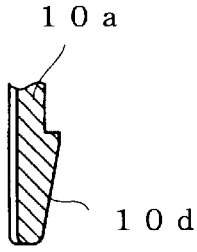
Figure 12A:
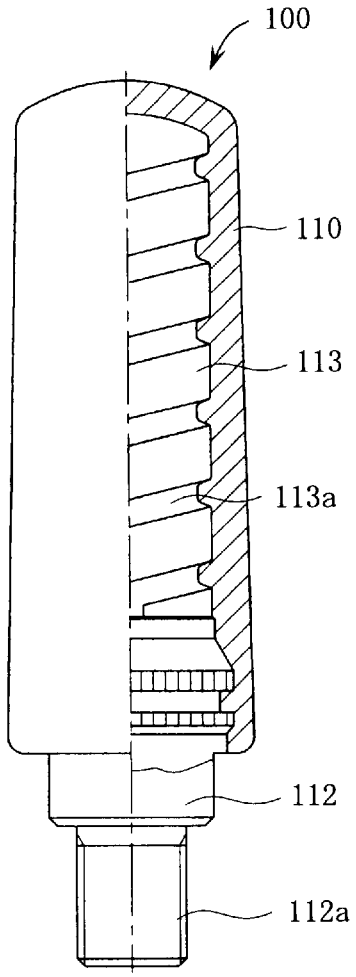
FIG. 12(a) Prior art
FIG. 12(*a*) is a half-sectional view showing the detailed an example of a constitution of a prior helical antenna.
Figure 12B:
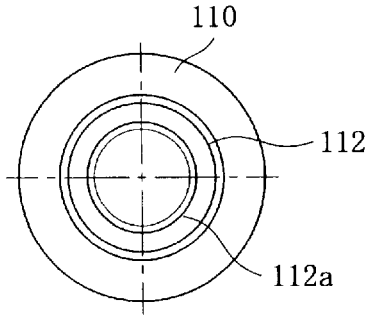
FIG. 12(b) Prior art

Next, the detailed constitution of coil element 13 is shown in FIG. 10.

As shown in this figure, coil element 13 is constituted from a coil portion 13*a*, which is formed by winding a wire in a helical shape, and a leading portion 13*b*, which is formed by bending the top end of the coil portion 13*a* so as to pass through the inside of the coil portion 13*a*. Further, a folded portion 13*c* is formed by folding the bottom end of leading portion 13*b*. Folded portion 13*c* is the part, which is press-fitted into press-fitting members 11*b* of contact terminal 11, and is electrically connected to contact terminal 11. Furthermore, because leading portion 13*b* is constituted so as to pass through the inside of coil portion 13*a*, and since leading portion 13*b* and coil portion 13*a* are coupled in a high-frequency condition, coil element 13 exhibits double resonance characteristics. According to this, by mounting helical antenna 4 related to the present invention to a cellular telephone, it becomes possible to operate the cellular telephone at two different frequency bands.

Furthermore, when coil element 13 is attached to bobbin 12, the bottom end of coil portion 13*a* makes contact with the top surface of bobbin base portion 12*b*, thus determining the length of coil portion 13*a*. This enables resonance frequency irregularities in coil element 13 to be held in check and made uniform.

FIG. 11 is a diagram showing the detailed constitution of top cover portion 10. FIG. 11(*a*) is a front view of top cover portion 10, FIG. 11(*b*) is a bottom view thereof, FIG. 11(*c*) is a cross-sectional view, which cuts along line F—F of FIG. 11(*b*), and FIG. 11(*d*) is an enlarged view of a portion thereof.

As shown in these drawings, top cover portion 10 is constituted from a cylindrical cover 10*b*, one end of which is closed, forming a sack-shaped storing portion 10*c*, and four coupling members 10*a*, which extend from the bottom end of cover 10*b*. As shown in FIG. 11(*d*), the coupling members 10*a* are constituted such that wedge-shaped portions 10*d* are formed at the ends [thereof], thereby forming coupling step portions on top of these [wedge-shaped portions 10*d*].

These four coupling members 10*a* are integrally formed at the bottom end of cover 10*b* when the top cover portion 10 is formed via plastic molding, and slotted portions 10*e* are formed between the coupling members 10*a*. First ribs 12*c* and second ribs 12*d* of bobbin 12, respectively, pass through these slotted portions 10*e* when top cover portion 10 is inserted and affixed to bobbin 12. Then, the top ends of slotted portions 10*e* constitute concave portions 10*f* formed in the bottom end of cover 10*b*, and the protruding portions 12*j* formed in the top ends of first ribs 12*c* and second ribs 12*d* are press-fitted into these concave portions 10*f*. Furthermore, by fitting top cover portion 10 to bobbin 12 by insertion, coil supporting portion 12*a*, which supports coil portion 13*a*, is stored in storing portion 10*c*.

In the above explanation, helical antenna 4 is treated as a double-resonance antenna, but it can also be used as a single-resonance antenna. Further, the constitution is such that a folded portion 13*c* is formed at the bottom end of leading portion 13*b* of coil element 13, but folded portion 13*c* does not always need to be provided.

In addition, as shown in FIG. 5 and FIG. 6, a helical antenna related to the present invention is assembled by fitting [the components together] without using an adhesive. Thus, when inspecting and verifying the electrical characteristics of helical antenna 4 following assembly, when these electrical characteristics need adjusting, [helical antenna 4] can be disassembled and adjustments can be made. Since verification inspections of electrical characteristics can be carried out following assembly, production yields can be improved.

Industrial Applicability

As explained hereinabove, the present invention is constituted such that the end of the coil element leading portion, which passes through the inside of a bobbin through-hole, is press-fitted inside press-fitting members of a contact terminal disposed inside the through-hole, and, in addition, by fitting the top cover portion to the bobbin by insertion, the top part of the bobbin, which supports the coil portion, is stored inside a storing portion. Accordingly, assembly of a helical antenna can be easily carried out without using special tools, making it possible to reduce costs.

Further, by inserting the helical antenna into a power supply fixture disposed in the casing of a portable radiotelephone, it becomes possible for coupling members provided on the top cover portion to mate with the power supply fixture, and for the helical antenna to be mounted in a fixed condition to the casing [of the portable radiotelephone]. This enables a helical antenna to be mounted in a fixed condition to the casing [of the portable radiotelephone] easily and in a short period of time.

In addition, since a contact terminal can be formed by processing a metal sheet, a coil element can be formed by processing a wire into a coil shape, and a bobbin and top cover portion can be easily formed via plastic molding, each part can be easily manufactured, enabling the cost of the helical antenna to be lowered.

What is claimed is:

1. A helical antenna, comprising:

a top cover portion, which has an approximately cylindrical storing portion with one end closed, and on which a plurality of coupling members extending from the bottom part is formed;

a coil element having a coil portion wound in a coil shape, and a leading portion extending from one end of this coil portion;

a bobbin, which holds said coil portion of this coil element, and, in which a through-hole, through which said leading portion is passed, is formed approximately along the central axis; and a conductive contact terminal, which is mounted to the bottom part of this bobbin, and in which a holding member disposed on the peripheral surface thereof, and press-fitting members disposed on the inside of said through-hole are formed, wherein the front end of said leading portion, which passes through said through-hole, is press-fitted inside said press-fitting members of said contact terminal, and said top cover portion is fitted over said bobbin so that the top part of said bobbin, which holds said coil portion, is stored inside said storing portion.

2. The helical antenna according to claim 1, characterized in that the holding member of said contact terminal is electrically connected to said power supply fixture when said coupling members are put through and mate with the power supply fixture disposed in the casing.

3. The helical antenna according to claim 1, characterized in that said contact terminal comprises said holding member, which is formed by being bent into the shape of a letter U, and press-fitting members consisting of elongated plates positioned approximately parallel to one another, which are formed to rise up from approximately the center portion of this holding member, and raised tabs are formed on these press-fitting members to prevent said contact terminal from slipping out when inserted into said through-hole.

4. The helical antenna according to claim 1, characterized in that a plurality of ribs is formed in the bottom part of said bobbin, and said coupling members are positioned between said ribs when said top cover portion is fitted over said bobbin.

5. The helical antenna according to claim 1, characterized in that, when said contact terminal is fitted to the bottom part of said bobbin, said holding member is positioned inside grooved portions formed on the surfaces of said ribs.

6. The helical antenna according to claim 1, characterized in that the cross-sectional shape of the through-hole formed in the bottom part of said bobbin into which said press-fitting members are inserted is made in the form of an H, and the cross-sectional shape of the through-hole, through which said leading portion of said coil element is passed, is made into the form of an I, and the bottom end of said leading portion is folded back.

* * * * *